US007816843B2

(12) United States Patent
Huvet et al.

(10) Patent No.: US 7,816,843 B2
(45) Date of Patent: Oct. 19, 2010

(54) LIGHT SIGNALING DEVICE

(75) Inventors: Jean-Marie Huvet, Ecueil (FR); Xavier Beaumont, Reims (FR)

(73) Assignee: OBSTA, Sevres (FR)

( * ) Notice: Subject to any disclaimer, the term of this patent is extended or adjusted under 35 U.S.C. 154(b) by 208 days.

(21) Appl. No.: 12/159,399

(22) PCT Filed: Dec. 26, 2006

(86) PCT No.: PCT/FR2006/002883

§ 371 (c)(1),
(2), (4) Date: Jun. 27, 2008

(87) PCT Pub. No.: WO2007/077364

PCT Pub. Date: Jul. 12, 2007

(65) Prior Publication Data

US 2008/0278051 A1 Nov. 13, 2008

(30) Foreign Application Priority Data

Dec. 30, 2005 (FR) ..... 05 54144

(51) Int. Cl.
*H01J 1/02* (2006.01)

(52) U.S. Cl. ..... 313/25

(58) Field of Classification Search ..... 313/25
See application file for complete search history.

(56) References Cited

U.S. PATENT DOCUMENTS

| | | | |
|---|---|---|---|
| 2,387,816 | A | 10/1945 | Wagner |
| 5,760,531 | A | 6/1998 | Pederson |

FOREIGN PATENT DOCUMENTS

| | | | |
|---|---|---|---|
| DE | 42 01 315 | A1 | 7/1993 |
| FR | 741 772 | A | 2/1933 |
| FR | 1 133 999 | A | 4/1957 |
| WO | 2004/114361 | A2 | 12/2004 |

*Primary Examiner*—Vip Patel
(74) *Attorney, Agent, or Firm*—Young & Thompson

(57) ABSTRACT

Luminous signalling device (1) includes one or more light tubes (8) and focusing elements (2, 3, 4, 5, 6, 7) for focusing a light beam, these elements being capable of focusing a light beam coming from the light tube(s), the elements for focusing a light beam comprising several cylindrical lenses (2, 3, 4, 5, 6, 7), each cylindrical lens having a longitudinal axis lying parallel to a straight section (9, 10, 11) of the light tube. The straight sections (9, 10, 11) are oriented in several directions around a predetermined azimuthal axis (A), the number and the orientation of the straight sections being chosen so that the light beams coming from the straight sections and focused by the cylindrical lenses (2, 3, 4, 5, 6, 7) are directed in all azimuthal directions about the azimuthal axis.

20 Claims, 4 Drawing Sheets

LIGHT SIGNALING DEVICE

This invention has as its object a light signaling device.

Signaling devices that are designed for airplanes are used on cables and/or elevated obstacles, for example pylons, and comprise means for focusing a light beam so as to emit the focused light in a predefined direction. The known focusing means generally use Fresnel lenses or parabolic mirrors.

These focusing means have the drawback of requiring heavy equipment for their production and therefore a costly investment. These focusing means are therefore not suitable for the production of small and medium series of signaling devices.

This invention has as its object to propose a signaling device that avoids at least some of the above-mentioned drawbacks and that comprises economic focusing means.

For this purpose, the invention has as its object a light signaling device that comprises one or more light tubes and means for focusing a light beam that can focus a light beam that comes from said light tube(s), whereby said means for focusing a light beam comprise several cylindrical lenses, whereby each cylindrical lens has a longitudinal axis that is arranged in a parallel manner to a rectilinear segment of a so-called light tube, characterized in that said rectilinear segments are oriented in several directions around a predetermined azimuth axis, whereby the number and the orientation of said rectilinear segments are selected such that the light beams that come from said rectilinear segments and that are focused by said cylindrical lenses are directed in all of the azimuthal directions around said azimuth axis.

According to one embodiment of the invention, at least one so-called cylindrical lens is arranged in an adjacent manner to said rectilinear segment. As a variant, the cylindrical lens can be arranged at a certain distance from the glow discharge tube.

The cylindrical lens or lenses may have any sectional shape that is able to focus the light from the glow discharge tube in the form of a flattened beam. Advantageously, at least one so-called cylindrical lens has an at least partially circular section, for example semi-circular or completely circular.

According to one embodiment of the invention, said focusing means comprise a first cylindrical lens and a second cylindrical lens, whereby said second cylindrical lens is arranged symmetrically to said first cylindrical lens relative to a plane that passes through the longitudinal axis of a so-called rectilinear segment of the light tube.

According to one embodiment of the invention, the plane that passes through the longitudinal axis of said second cylindrical lens and through the longitudinal axis of said rectilinear segment is offset from the plane that passes through the longitudinal axis of said first cylindrical lens and through the longitudinal axis of said rectilinear segment by an angle that determines an elevation angle for the beam that is focused by said cylindrical lenses.

According to one embodiment, said device comprises a single light tube that comprises several rectilinear segments that are connected to one another, whereby said focusing means comprise a number of cylindrical lenses that are arranged respectively in a parallel manner to a number of said rectilinear segments.

According to another embodiment, said device comprises several light tubes, whereby each of said light tubes comprises a rectilinear segment, whereby said focusing means comprise a number of cylindrical lenses that are arranged respectively in a parallel manner to a number of said rectilinear segments.

According to one embodiment, said device comprises at least n rectilinear segments, whereby n is a positive integer and the longitudinal axes of said n rectilinear segments are offset, two by two, by an angle of 180°/n.

According to another embodiment, said device comprises at least n rectilinear segments, whereby n is a positive integer and the longitudinal axes of said n rectilinear segments are offset, two by two, by an angle of 360°/n.

The device can be produced on one or more levels. Advantageously, said rectilinear segments are arranged in at least two parallel planes, whereby at least one cylindrical lens that is arranged parallel to a rectilinear segment in an upper plane rests on at least one cylindrical lens that is arranged parallel to a rectilinear segment in a lower plane.

Preferably, the device comprises a protective envelope in which said focusing means are arranged, whereby said protective envelope has a symmetry of revolution along an azimuth axis, whereby said protective envelope is made of a transparent material.

According to one embodiment of the invention, said protective envelope has an approximately cylindrical shape.

For example, the ratio between the diameter of the rectilinear segment of the glow discharge tube and the diameter of a so-called cylindrical lens is encompassed between 0.3 and 0.4 and a so-called cylindrical lens has a length of more than 60 mm.

According to one embodiment of the invention, at least one cylindrical lens is made of solid glass.

According to another embodiment of the invention, at least one cylindrical lens is produced by a hollow glass envelope that is filled with a liquid whose refraction index is close to that of the glass.

Preferably, a so-called cylindrical lens is attached to a rectilinear segment using a support that is attached to, on the one hand, said cylindrical lens, and on the other hand, said rectilinear segment.

Advantageously, said support is metallic.

According to one embodiment of the invention, said support has essentially a square shape, whereby said support is attached to said rectilinear segment at the level of the angle of said square, to said cylindrical lens at the level of a face of said square, and to a second cylindrical lens at the level of the second face of said square.

Advantageously, the attachment of said support to said rectilinear segment and to said lens is carried out by gluing.

According to one embodiment, said light tube is a glow discharge tube. In this embodiment, advantageously, the device comprises supply means that are connected to said glow discharge tube and are able to generate an electrical discharge at a predetermined frequency in said glow discharge tube.

The invention will be better understood, and other objects, details, characteristics and advantages of the latter will emerge more clearly during the following detailed explanatory description of an embodiment of the invention that is provided by way of a purely illustrative and non-limiting example with reference to the accompanying diagrammatic drawings.

Figure 1:
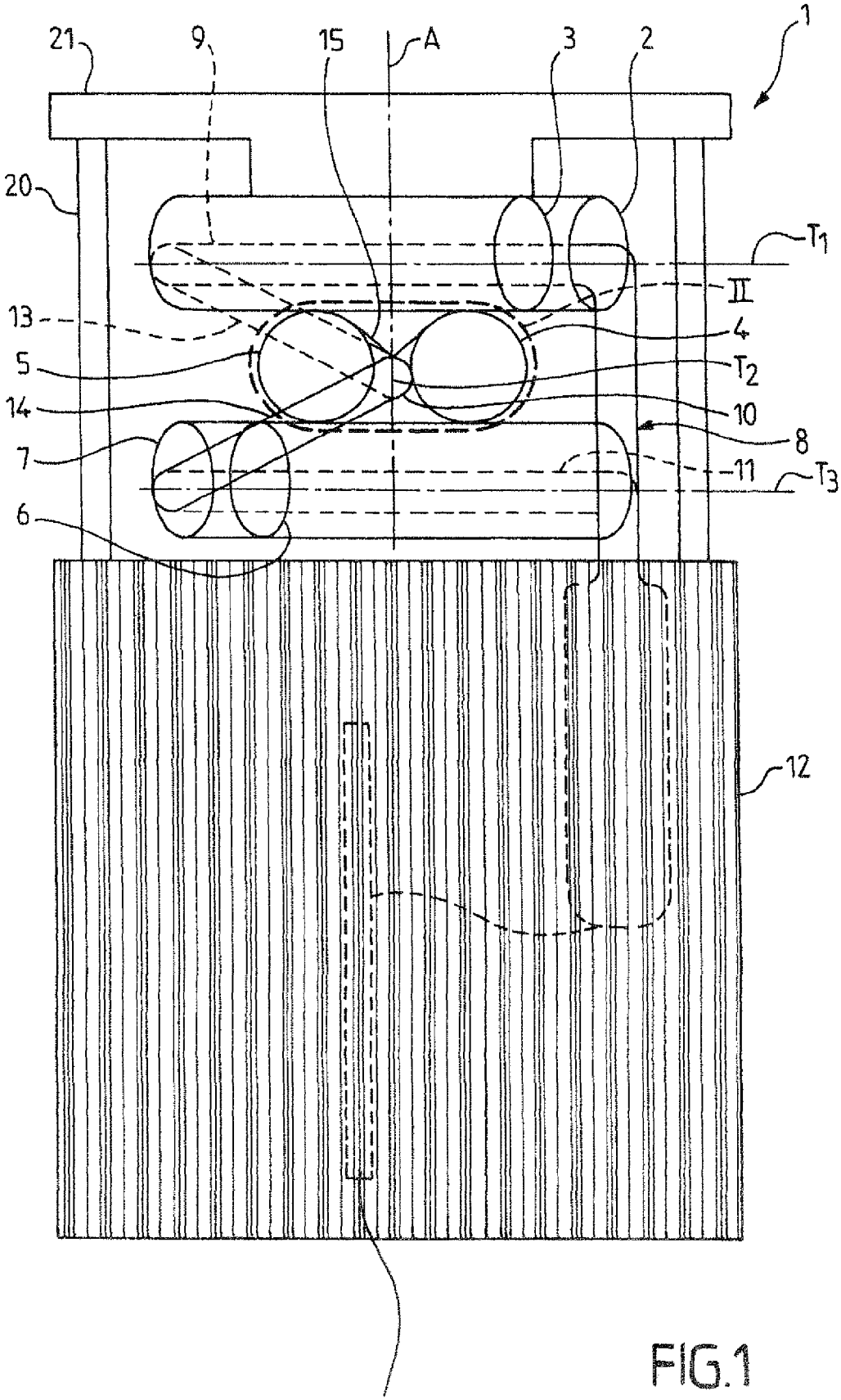
FIG. 1 is a simplified diagrammatic side view of a signaling device according to an embodiment of the invention.
Figure 2:
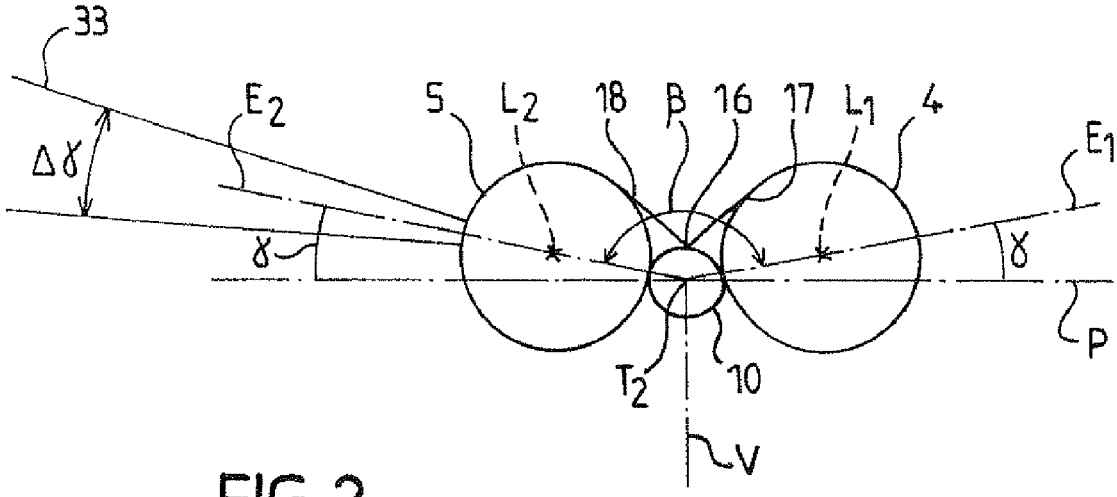
FIG. 2 is an enlarged view of zone II of FIG. 1.
Figure 6:
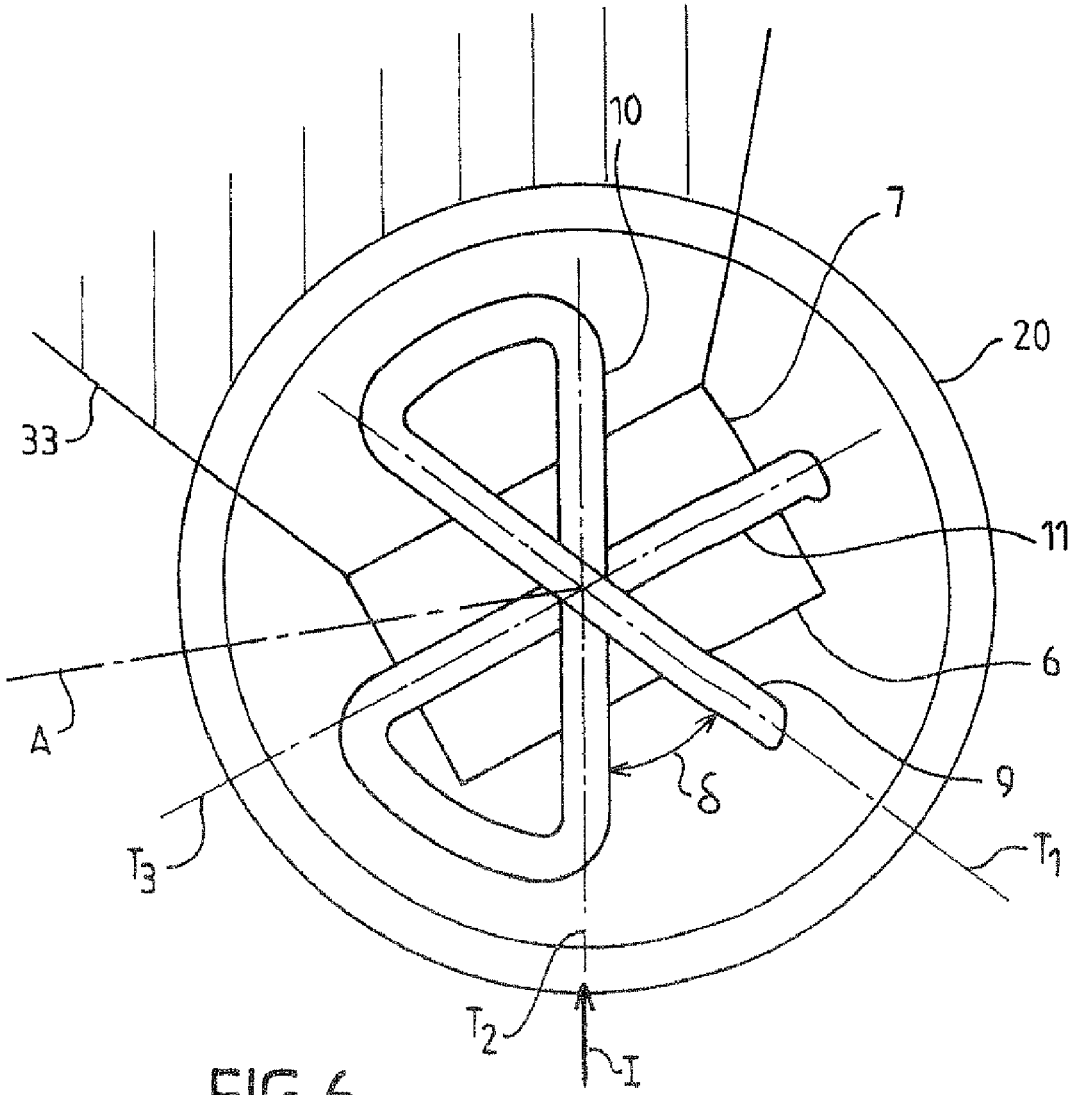
FIG. 6 is a simplified partial diagrammatic top view of the signaling device of FIG. 1.

By referring to FIGS. 1, 2 and 6, a signaling device 1 that is designed to be attached to a pylon (not shown) or to another elevated obstacle is seen to perform the function of a signal beacon for airplane pilots.

The signaling device 1 comprises six circular-section cylindrical lenses 2, 3, 4, 5, 6 and 7. In FIG. 6, only the lenses 6 and 7 have been shown for the sake of clarity. Each cylindrical lens 2, 3, 4, 5, 6, and 7 has, for example, a length that is approximately equal to 70 mm and a diameter that is approximately equal to 20 mm. The cylindrical lenses 2, 3, 4, 5, 6 and 7 are made of glass. As a variant, the cylindrical lenses 2, 3, 4, 5, 6 and 7 can comprise a hollow glass envelope, whereby the envelope is filled with a liquid whose refraction index is close to the glass index, for example glycerin water or another liquid whose refraction index is high enough, for example on the order of 1.5. The glass that is used is, for example, a standard-type Pyrex glass.

The signaling device 1 comprises a glow discharge tube 8 that comprises three rectilinear segments 9, 10 and 11. The glow discharge tube 8 is made of glass and is, for example, a neon or xenon tube. The two ends of the tube 8 are closed in an airtight manner by an electrode after the filling of neon or xenon. The glow discharge tube 8 is connected to a supply device 12 that can generate voltage between the electrodes to maintain the glow discharge. The supply device 12 has, for example, an input voltage of between 12 and 48 $V_{DC}$ and uses a power of 6 W.

Each rectilinear segment 9, 10, 11 has, for example, a diameter that is approximately equal to 7 mm. The rectilinear segments 9, 10, 11 are connected to one another by connecting segments 13 and 14. The rectilinear segments 9, 10, 11, two by two, form an angle δ of 60% in top view and are arranged one on top of the other, i.e., each rectilinear segment cuts an azimuth axis A approximately in its middle.

The rectilinear segment 9 (respectively 10, 11) is attached to two cylindrical lenses 2 and 3 (respectively 4 and 5, 6 and 7), arranged along the rectilinear segment 9 (respectively 10, 11), in an adjacent manner to the latter. The cylindrical lenses 2 and 3 (respectively 4 and 5, 6 and 7) are arranged symmetrically—one relative to the other—relative to a vertical plane V that passes through the axis T1 (respectively T2, T3) of the rectilinear segment 9 (respectively 10, 11).

The horizontal plane P that passes through the axis T2 and the plane E1 that passes through the axis T2 and the axis L1 of the cylindrical lens 4 form an angle γ between them. The horizontal plane P that passes through the axis T2 and the plane E2 that passes through the axis T2 and the axis L2 of the cylindrical lens 5 form an angle γ between them. The lenses 4 and 5 are at the same horizontal level so as to project the light along the same elevation angle in two opposite azimuthal directions. In other words, the plane E1 and the plane E2 form an angle β between them, with $\beta=180°-2*\gamma$. In a similar manner, the horizontal plane that passes through the axis T1 (respectively T3) and the plane that passes through the axis T1 (respectively T3) and the axis of the cylindrical lens 2, 3 (respectively 6, 7) form an angle γ between them.

The length of each rectilinear segment 9, 10, 11 is designed so that the glow discharge tube 8 can emit light within the entire length of the corresponding cylindrical lenses 2, 3, 4, 5, 6, 7. For this purpose, the length of each rectilinear segment 9, 10, 11 is slightly more than the length of the cylindrical lenses 2, 3, 4, 5, 6, 7. Each rectilinear segment 9, 10, 11 has, for example, a length that is essentially equal to 100 mm.

A support 15 makes it possible to attach the cylindrical lenses 4, 5 to the rectilinear segment 10. The support 15 has a square shape and, for example, is made of metal. The length of the square 15 is, for example, slightly less than the length of the cylindrical lenses 4, 5. The angle 16 of the square 15 is attached along the rectilinear segment 10, for example by gluing. The edge 17 of the square 15 is attached along the cylindrical lens 4, for example by gluing. The edge 18 of the square 15 is attached along the cylindrical lens 5, for example by gluing. The square 15 makes it possible to avoid direct gluing between the rectilinear segment 10 and the cylindrical lenses 4 and 5 that would bring about a loss in light intensity IL, in particular because of diffraction due to the presence of glue in the optical path. The cylindrical lenses 2 and 3 (respectively 6 and 7) are attached in a similar manner to the rectilinear segment 9 (respectively (11)), by a support (not shown) that is identical to the support 15.

The length of the connecting segments 13, 14 is designed so that the cylindrical lenses 2 and 3 rest on the cylindrical lenses 4 and 5 and so that the cylindrical lenses 4 and 5 rest on the cylindrical lenses 6 and 7. This arrangement makes it possible to ensure an overall rigidity of the device 1 without requiring attachment between the cylindrical lenses 2, 3, 4, 5, 6, 7 of the various levels. Thus, the device can be made compact enough by an arrangement on several levels that are arranged one on top of the other. Whereby the load of upper levels is taken up directly by the cylindrical lenses of the lower levels, the glow discharge tube does not undergo excessive constraint. As a variant, the cylindrical lenses 2, 3, 4, 5, 6, 7 of the various levels call be attached between them.

The signaling device 1 comprises a protective envelope 20. The protective envelope 20 has a symmetry of revolution along the azimuth axis A, i.e., it has, for example, an overall cylindrical or conical shape. The protective envelope 20 is made of a transparent material, for example, glass. The protective envelope 20 is closed by a removable cover 21 that makes it possible to replace the optic in the event the glow discharge tube fails. As a variant, the cover 21 can be sealed in the protective envelope 20. In this variant, in the event the glow discharge tube 8 fails, the protective envelope 20 is also replaced.

The cylindrical lenses of the upper level, i.e., the lenses 2 and 3, can be attached to the cover 21.

Figure 3:
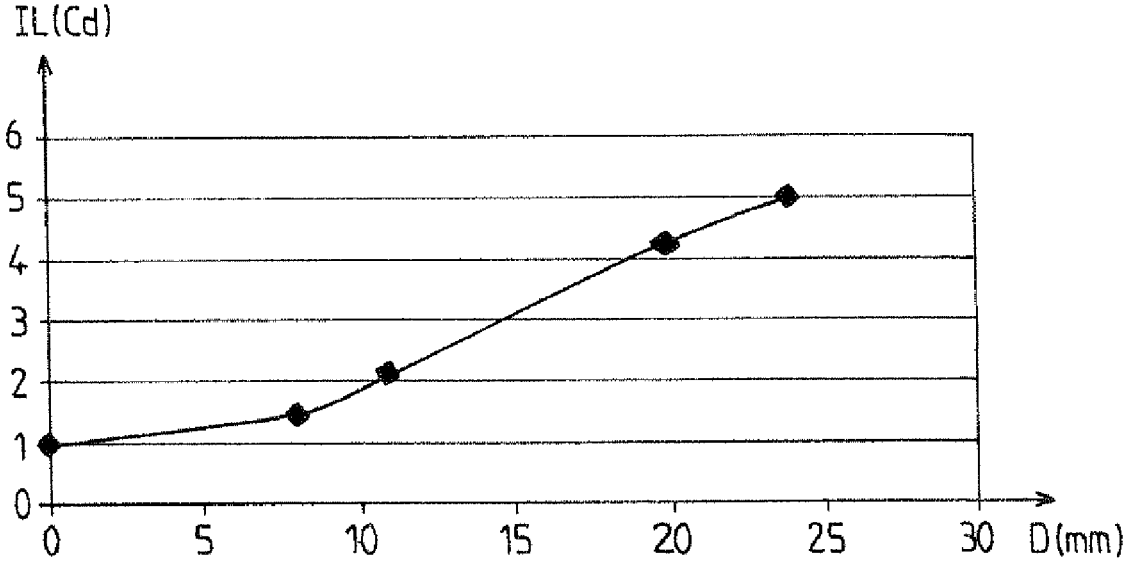
FIG. 3 is a curve that shows the evolution of the maximum light intensity of the focused beam based on the diameter of the cylindrical lens.
Figure 4:
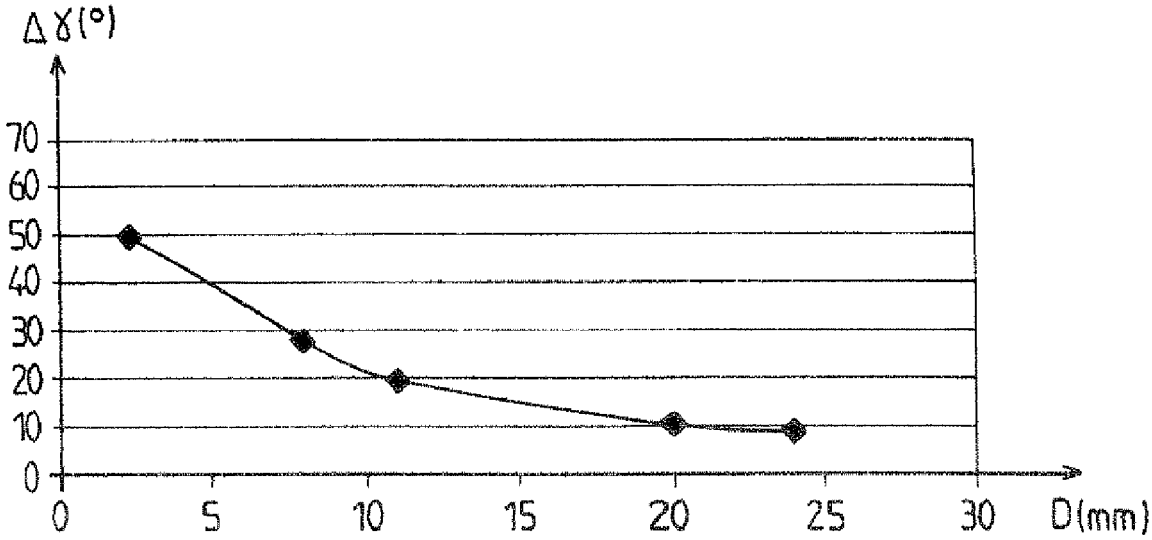
FIG. 4 is a curve that shows the evolution of an angular aperture of the focused beam along the elevation angle based on the diameter of the cylindrical lens.

By referring to FIGS. 3 to 5, the operation of the signaling device 1 will now be described according to the embodiment.

When the glow discharge tube 8 is supplied by the supply device 12, light is emitted from the glow discharge tube 8 in all directions, in a way that is known in the art. It will be noted that the parts of the glow-discharge tube 8 that are not lengthened by a cylindrical lens 2, 3, 4, 5, 6, 7, in particular the connecting segments 13 and 14, unnecessarily consume the energy since they diffuse—in all directions—the light that cannot be focused. The embodiment shown in FIG. 1 makes it possible to reduce the losses by producing each rectilinear segment 9, 10, 11 with a length that is close to the length of the cylindrical lenses 2, 3, 4, 5, 6, 7 and by limiting the length of the connecting segments 13, 14.

The light that is emitted by the glow discharge tube 8 that passes through the cylindrical lens 5 forms a focused beam 33 such that the maximum light intensity is emitted in the plane E2 (FIG. 2). The angle between the horizontal plane P and the center of the light beam 33, i.e., the plane E2, is called elevation angle γ of the light beam. The angle between the plane P and the plane E2 corresponds to the desired elevation angle, such that the signal beacon is seen from the aircraft at a sufficient safety distance. This angle is, for example, approximately equal to 8°. It will be noted that the device 1 allows a particularly simple adjustment of the angle γ. The angular width Δγ of the beam 33 depends in particular on the diameter D of the cylindrical lens 5, as is shown in FIG. 4. The planes that delimit the angular width Δγ are defined, for example, at mid-amplitude of the maximum light intensity.

The focused light beams that come from the cylindrical lenses 2, 3, 4, 6 and 7 are obtained in a similar manner. It will be noted that the cylindrical lenses 2, 3, 4, 5, 6 and 7 are positioned such that the various focused light beams 33 have approximately the same light intensity IL for the same elevation angle γ since the cylindrical lenses are offset by the same angle γ.

The azimuth aperture angle of the beam that is focused by the cylindrical lens 7, i.e., the angle that is covered by the focused beam 33 relative to the axis A as can be seen in FIG. 6, depends on the relative diameters of the rectilinear segment 10 and the cylindrical lens 7 as well as the length of the cylindrical lens 7. The azimuth angle is, for example, encompassed between 60 and 120°.

The azimuth aperture angles of the focused beams that come from the cylindrical lenses 2, 3, 4, 5 and 6 are determined in a similar manner and are identical here.

The signaling device 1 allows the emission of light beams that are focused in all of the azimuthal directions by the combination of the light beams that are focused by the cylindrical lenses 2, 3, 4, 5, 6 and 7. It will be noted that in the described embodiment, the various light beams are arranged partially on top of one another.

The focusing of the light that is emitted by the glow discharge tube 8 makes it possible to reduce the consumption of electrical power that is necessary to obtain a given light intensity in the selected direction, i.e., in the desired direction of elevation.

For each cylindrical lens 2, 3, 4, 5, 6, 7, the maximum light intensity, i.e., the light intensity IL that is emitted in the desired direction of elevation, depends on the length of the cylindrical lens. For a given glow discharge tube diameter 8, when the diameter of the cylindrical lens increases, the light intensity IL increases, as is shown in FIG. 3. The maximum light intensity is, for example, on the order of 10 candelas with emission in the red.

The signaling device 1 does not require the use of a mold or heavy equipment for the production of focusing means, i.e., the cylindrical lenses 2, 3, 4, 5, 6 and 7. The cylindrical lenses are obtained by spinning and require neither polishing nor machining. The device 1 therefore does not require costly investment, and it thus is particularly suitable for the production of small and medium series of signaling devices.

Other variants are possible. For example, the cylindrical lenses 2, 3, 4, 5, 6, and 7 and the glow discharge tube 8 are not necessarily adjacent. The optimum distance between the glow discharge tube 8 and a cylindrical lens 2, 3, 4, 5, 6 and 7 depends on the focal-length position. This optimum distance is, for example, determined experimentally. It will be noted that the angular width Δγ depends on the distance between the glow discharge tube 8 and the cylindrical lens 2, 3, 4, 5, 6, 7.

The lengths and diameters of the rectilinear segments 9, 10, 11 and cylindrical lenses 2, 3, 4, 5, 6 and 7 may be different from the examples that are provided in this description.

Figure 5:
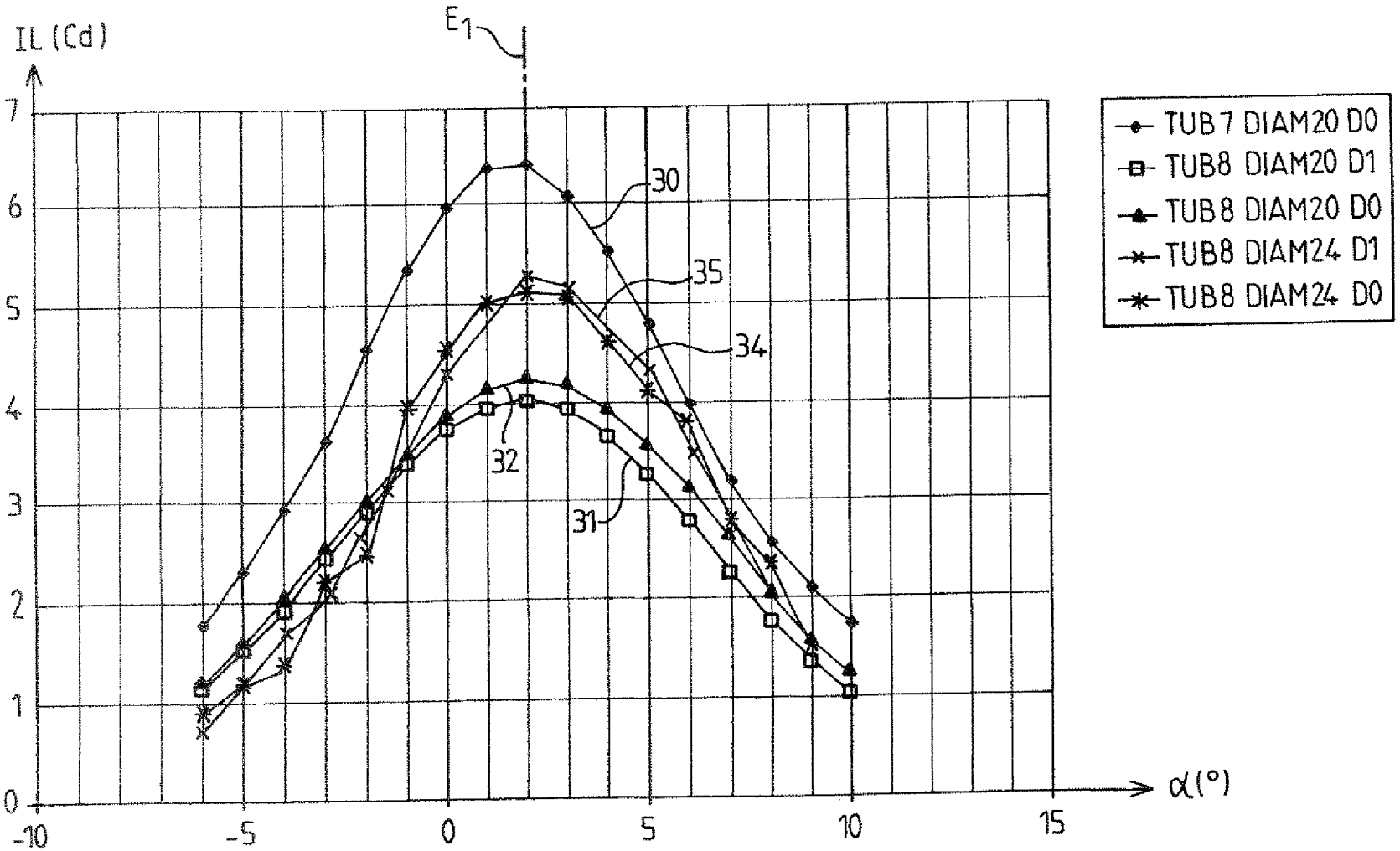
FIG. 5 shows a series of curves showing the evolution of the light intensity based on the elevation angle for various embodiments of the glow discharge tube-cylindrical lens unit.

FIG. 5 shows light intensity profiles IL that are emitted based on the angle α between the plane P and the emission plane.

The curve 30 is obtained with a glow discharge tube diameter 8 that is equal to 7 mm, and a lens diameter 4 that is equal to 20 mm, whereby the lens 4 is adjacent to the glow discharge tube 8.

The curve 31 is obtained with a glow discharge tube diameter 8 that is equal to 8 mm, and a lens diameter 4 that is equal to 20 mm, whereby the lens 4 is spaced from the glow discharge tube 8 by about 1 mm.

The curve 32 is obtained with a glow discharge tube diameter 8 that is equal to 8 mm, and a lens diameter 4 that is equal to 20 mm, whereby the lens 4 is adjacent to the glow discharge tube 8.

The curve 35 is obtained with a glow discharge tube diameter 8 that is equal to 8 mm, and a lens diameter 4 that is equal to 24 mm, whereby the lens 4 is separated from the glow discharge tube 8 by about 1 mm.

The curve 34 is obtained with a glow discharge tube diameter 8 that is equal to 8 mm, and a lens diameter 4 that is equal to 24 mm, whereby the lens 4 is adjacent to the glow discharge tube 8.

The curves 30, 31, 32, 34 and 35 are essentially bell-shaped, whereby the tip of the bell, i.e., the elevation angle γ in which the maximum intensity is emitted, is found in the plane E1. The maximum intensity of the curve 30 is higher; i.e., a higher light intensity is emitted in the desired direction, and therefore the signaling device is more visible. This is consistent with the curves of FIGS. 3 and 4 that show that the beam is focused in an increasingly narrow angular sector with an increasingly high intensity, in proportion as the diameter of the lens increases.

The signaling device can comprise four pairs of cylindrical lenses. In this case, the angle between the rectilinear segments taken two by two is approximately equal to 45°. More generally, the signaling device can comprise any number n of rectilinear segments, whereby n is a positive integer and the segments, two by two, form an angle of 180°/n, and whereby the signaling device comprises n pairs of cylindrical lenses.

The signaling device can comprise several rectilinear segments, combined with cylindrical lenses, parallel to one another. This configuration makes it possible to multiply the light intensity that is emitted.

The glow discharge tube can comprise three rectilinear segments that are arranged essentially in a triangle. In this case, a cylindrical lens is arranged on each rectilinear segment, toward the outside of the triangle. Reflectors can be arranged essentially adjacent to the rectilinear segments inside the triangle to limit the light losses. More generally, the rectilinear segments can form any polygon between them, whereby the objective is to cover all of the azimuthal directions. The angle between the rectilinear segments in this case is equal to 360°/n, whereby n is the number of rectilinear segments.

Several glow discharge tubes can be used instead of the glow discharge tube comprising several rectilinear segments that are connected to one another by connecting segments. In this case, a glow discharge tube can be used in combination with a pair of cylindrical lenses. Each glow discharge tube is connected to the supply device. This embodiment provides additional safety in the event a glow discharge tube fails. In this variant, several supply devices can be provided; for example, an independent supply device can be connected to each glow discharge tube. This embodiment provides additional safety in the event a supply device fails.

The light can be emitted continuously or intermittently, which makes it possible to obtain fixed or blinking signaling devices.

The glow discharge tube can be replaced by another light tube, i.e., by any light source that can emit light along a tube, for example a filament lamp, a halogen lamp, or an electroluminescent diode (LED).

The circular-section cylindrical lenses have the advantage of facilitating the assembly of the device owing to their symmetry of revolution. However, the cylindrical lenses do not necessarily have a circular section. A cylindrical lens can, for example, have a semi-cylindrical section. More generally, the term cylindrical is to be interpreted here as produced by a generatrix that is parallel to a fixed direction that rests on a flat curve, a so-called directrix.

Although the invention has been described in connection with a particular embodiment, it is quite obvious that it is in no way limited and that it comprises all the equivalent techniques of the means that are described as well as their combinations if the latter enter within the scope of the invention.

The invention claimed is:

1. A light signaling device (1) that comprises:

one or more light tubes (8); and a plurality of cylindrical lenses (2, 3, 4, 5, 6, 7) focusing a light beam of said light tubes, wherein, each cylindrical lens has a longitudinal axis (L1, L2) that is arranged in a parallel manner to a rectilinear segment (9, 10, 11) of a so-called light tube, said rectilinear segments (9, 10, 11) are oriented in a plurality of directions around a predetermined azimuth axis (A), and the number and the orientation of said rectilinear segments are selected such that the light beams that come from said rectilinear segments and that are focused by said cylindrical lenses (2, 3, 4, 5, 6, 7) are directed in all of the azimuthal directions around said azimuth axis.

2. The device according to claim 1, wherein at least one so-called cylindrical lens (2, 3, 4, 5, 6, 7) is arranged in an adjacent manner to a so-called rectilinear segment (9, 10, 11).

3. The device according to claim 1, wherein at least one so-called cylindrical lens (2, 3, 4, 5, 6, 7) has an at least partially circular segment.

4. The device according to claim 1, wherein said plurality of cylindrical lenses comprise a first cylindrical lens (4) and a second cylindrical lens (5), whereby said second cylindrical lens (5) is arranged symmetrically to said first cylindrical lens (4) relative to a plane (V) that passes through the longitudinal axis (T2) of a so-called rectilinear segment (10).

5. The device according to claim 4, wherein the plane that passes through the longitudinal axis (L2) of said second cylindrical lens (5) and through the longitudinal axis (T2) of said rectilinear segment (10) is offset from the plane (E) that passes through the longitudinal axis (L1) of said first cylindrical lens and through the longitudinal axis (T2) of said rectilinear segment (8) by an angle (β) that determines an elevation angle for the beams that are focused by said cylindrical lenses (4, 5).

6. The device according to claim 1, wherein it comprises a single light tube (8) that comprises a plurality of rectilinear segments (9, 10, 11) that are connected to one another, and said plurality of cylindrical lenses (2, 3, 4, 5, 6, 7) are arranged respectively in a parallel manner to a number of said rectilinear segments.

7. The device according to claim 1, wherein it comprises several light tubes, each of said light tubes comprises a rectilinear segment and said plurality of cylindrical lenses (2, 3, 4, 5, 6, 7) are arranged respectively in a parallel manner to a number of said rectilinear segments.

8. The device according to claim 6, wherein it comprises at least n rectilinear segments (9, 10, 11), whereby n is a positive integer and the longitudinal axes (T1, T2, T3) of said n rectilinear segments are offset, two by two, by an angle of 180°/n.

9. The device according to claim 6, wherein it comprises at least n rectilinear segments (9, 10, 11), whereby n is a positive integer and the longitudinal axes (T1, T2, T3) of said n rectilinear segments are offset, two by two, by an angle of 360°/n.

10. The device according to claim 6, wherein said rectilinear segments (9, 10, 11) are arranged in at least two parallel planes, whereby at least one cylindrical lens (2, 3) that is arranged parallel to a rectilinear segment (9) in an upper plane rests on at least one cylindrical lens (4, 5) that is arranged parallel to a rectilinear segment (10) in a lower plane.

11. The device according to claim 1, wherein it comprises a protective envelope (20) in which there are arranged: said plurality of cylindrical lenses, said protective envelope that has a symmetry of revolution along an azimuth axis (A), and said protective envelope that is made of a transparent material.

12. The device according to claim 11, wherein said protective envelope (20) has an approximately cylindrical shape.

13. The device according to claim 1, wherein at least one cylindrical lens (2, 3, 4, 5, 6, 7) is made of solid glass.

14. The device according to claim 1, wherein at least one cylindrical lens (2, 3, 4, 5, 6, 7) is made of a hollow glass envelope that is filled with a liquid whose refraction index is close to that of the glass.

15. The device according to claim 1, wherein a so-called cylindrical lens (2, 3, 4, 5, 6, 7) is attached to a rectilinear segment (9, 10, 11) using a support (15) that is attached to, on the one hand, said cylindrical lens, and, on the other hand, said rectilinear segment.

16. The device according to claim 15, wherein said support (15) is metallic.

17. The device according to claim 15, wherein said support (15) has essentially a square shape, whereby said support (15) is attached to said rectilinear segment (10) at the level of the angle (16) of said square, to said cylindrical lens (4) at the level of a face (17) of said square, and to a second cylindrical lens (5) at the level of the second face (18) of said square.

18. The device according to claim 15, wherein the attachment of said support (15) to said rectilinear segment (10) and to said lens (4, 5) is carried out by gluing.

19. The device according to claim 1, wherein the light tube is a glow discharge tube.

20. The device according to claim 19, wherein it comprises supply device (12) that is connected to said glow discharge tube and that can generate an electrical discharge at a predetermined frequency in said glow discharge tube (8).

* * * * *